US008573990B2

(12) United States Patent
Cheng et al.

(10) Patent No.: US 8,573,990 B2
(45) Date of Patent: Nov. 5, 2013

(54) COVER STRUCTURE

(75) Inventors: Hsu-Chih Cheng, Taipei (TW); Chia-Hua Chu, Taipei (TW); Bo-Shiun Luo, Taipei (TW)

(73) Assignee: Inventec Corporation, Taipei (TW)

( * ) Notice: Subject to any disclaimer, the term of this patent is extended or adjusted under 35 U.S.C. 154(b) by 53 days.

(21) Appl. No.: 13/314,298

(22) Filed: Dec. 8, 2011

(65) Prior Publication Data

US 2013/0059454 A1 Mar. 7, 2013

(30) Foreign Application Priority Data

Sep. 6, 2011 (TW) ..... 00132016 A

(51) Int. Cl.
*H01R 13/44* (2006.01)

(52) U.S. Cl.
USPC ..... 439/135

(58) Field of Classification Search
USPC ..... 439/135–140, 142, 326, 352–357, 76.1
See application file for complete search history.

(56) References Cited

U.S. PATENT DOCUMENTS

| | | | | |
|---|---|---|---|---|
| 5,611,695 | A * | 3/1997 | Bentley | 439/35 |
| 5,788,530 | A * | 8/1998 | Kasai | 439/372 |
| 5,822,183 | A * | 10/1998 | Kanda et al. | 361/679.32 |
| 5,933,328 | A * | 8/1999 | Wallace et al. | 361/737 |
| 6,483,698 | B1 * | 11/2002 | Loh | 361/679.41 |
| 7,416,450 | B2 * | 8/2008 | Wu et al. | 439/630 |
| 7,771,239 | B1 * | 8/2010 | Hsiao | 439/640 |
| 8,313,347 | B2 * | 11/2012 | He et al. | 439/607.07 |

* cited by examiner

*Primary Examiner* — Jean F Duverne
(74) *Attorney, Agent, or Firm* — WPAT, PC; Justin King

(57) ABSTRACT

A cover structure, adapted for mounting on a housing that is formed with an opening and a connection base having a plugging end exposing by the opening, comprising: a frame, formed with a first end and a second end that are arranged opposite to each other with respect to the radial of a coupling position where the frame is coupled to the housing through a pivot axis of two pivot blocks in a direction parallel to a first axis direction and enabling the first end to expose by the opening; and an elastic element, disposed inside the housing for providing an elastic force to the frame, for enabling the first end and the second end to move relative to each other centering the coupling position; wherein an accommodation space is formed between the frame and the connection base so as to be used for receiving a plug of a connector.

9 Claims, 6 Drawing Sheets

COVER STRUCTURE

FIELD OF THE INVENTION

The present invention relates to a cover structure, and more particularly, to a cover structure designed to construct an accommodation between itself and a connection base so as to be provided for a connector to plug therein while enabling the connector to be subjected to a clamping force and thus enabling the plugging of the connector into the connection base to be fixedly secured without the danger of loosening.

BACKGROUND OF THE INVENTION

In response to the trend of lighter, thinner, and miniature of the development of electronic products, the parts or units to be used in the electronic products are becoming more and more structurally simplified and thus smaller in volume. Please refer to FIG. 1, which shows a prior-art thin-type connection base. As shown in FIG. 1, the thin-type connection base 10 is designed for a connector 20 to plug therein, whereas the connector 20 can be a RJ45 connector. As the thin-type connector 10 is formed like a top cover and is able half the volume of other conventional connectors, especially in thickness, such thin-type connection base 10 is specifically designed for those modern electronic products that are to be built thinner and lighter. In FIG. 1, the thin-type connection base 10 is mounted on a circuit board 11, whereas the circuit board 11 along with the thin-type connection base 10 is disposed inside the housing of an electronic device. As the housing is formed with an opening, a connector 20 can be plugged into the thin-type connection base 10 through the opening so as to connect electrically with the circuit board 11.

However, such prior-art thin-type connection base 10 may not be preferred by users as it is disadvantageous in that: since the connector 20 is simply being inserted into the port of the connection base 10 without the use of any means for fixedly securing the same therein, the connector 20 can easily escape from the constrain of the connection base 20, resulting that the electrically connection between the connector 20 and thin-type connection base 10 can be broken very easily.

SUMMARY OF THE INVENTION

In view of the disadvantages of prior art, the primary object of the present invention is to provide a cover structure designed to enable an accommodation space to be formed between itself and a connection base so as to be provided for a connector to plug therein while enabling the connector to be subjected to a clamping force and thus enabling the plugging of the connector into the connection base to be fixedly secured without the danger of loosening.

To achieve the above object, the present invention provides a cover structure, adapted for mounting on a housing, the housing having a connection base, an opening formed in the housing, the connection base having a plugging end arranged exposing by the opening, is disclosed, which comprises:

a frame, pivoted to the housing, the frame including two pivot blocks arranged in a direction parallel to a first axis direction and the frame formed with a first end and a second end, the first and the second ends arranged on two opposite sides of the pivot axis of the pivot blocks, and the first end to expose by the opening; and an elastic element, being arranged inside the housing for providing an elastic force to the frame to enable the frame to rotate pivotally along the pivot axis;

wherein, an accommodation space is formed between the frame and the connection base, the frame is rotating pivotally to an opening position with respect to the housing, while allowing a part of a plug of a connector is receiving in the accommodation space.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
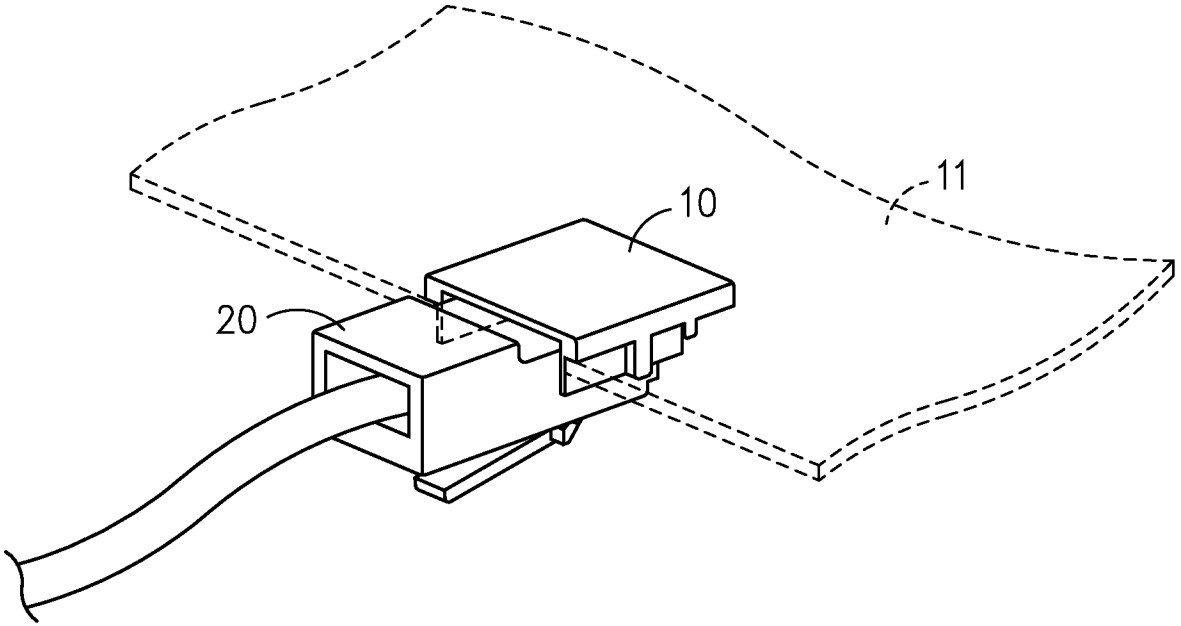
FIG. 1(Prior Art)
FIG. 1 shows a prior-art thin-type connection base.
Figure 2:
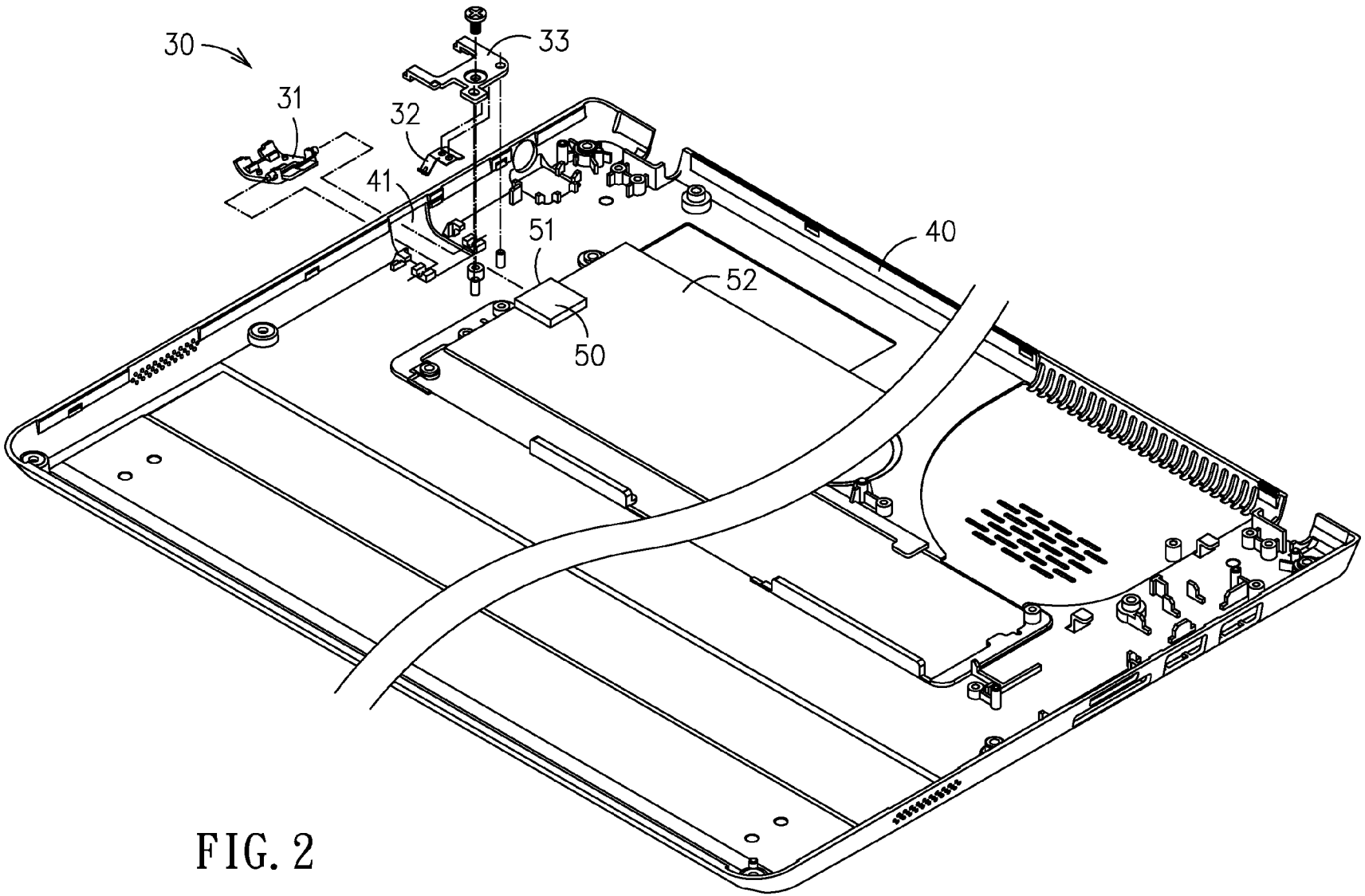
FIG. 2 is an exploded view of a cover structure according to an embodiment of the present invention.
Figure 3:
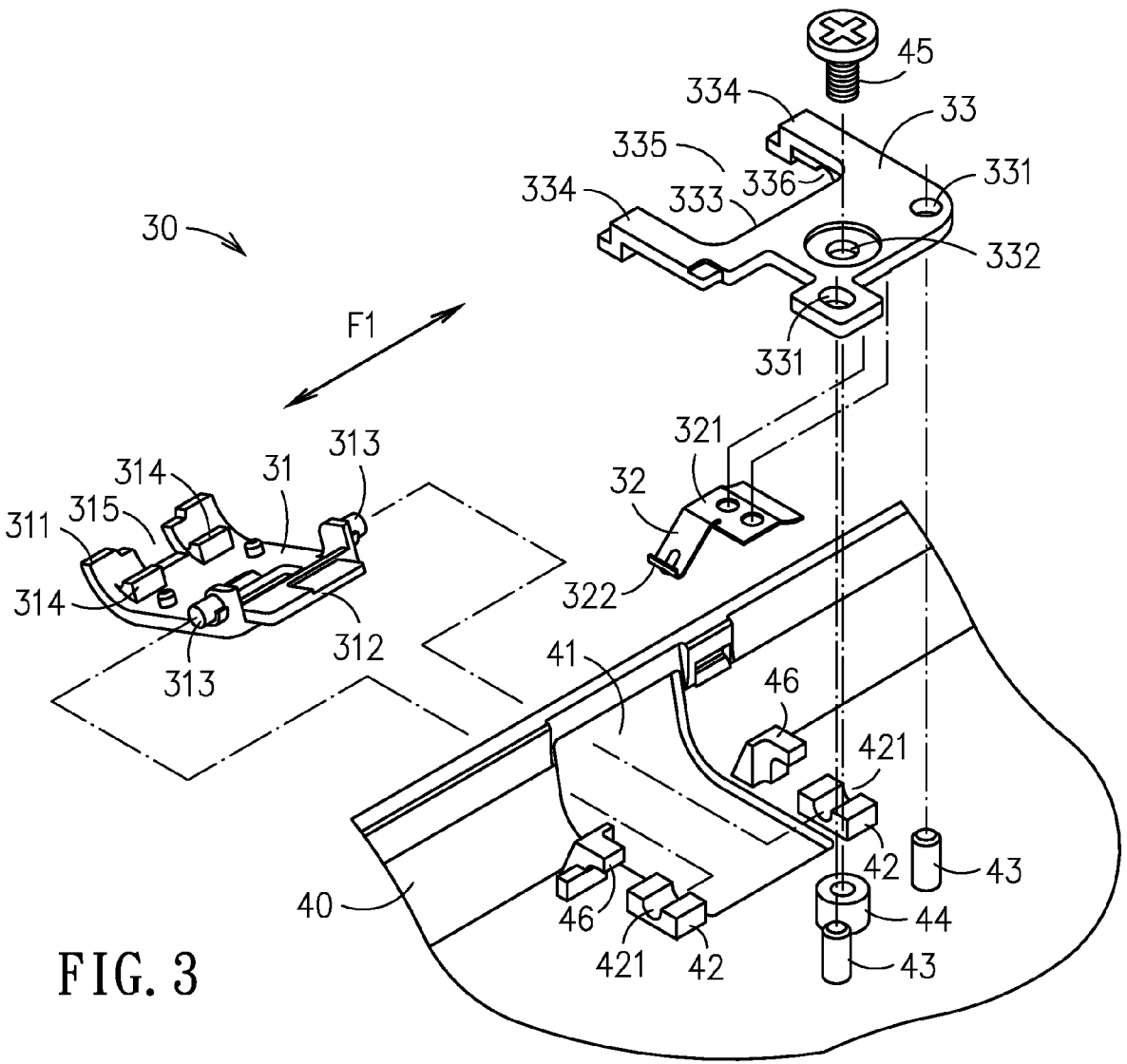
FIG. 3 is partly enlarged view of the cover structure shown in FIG. 2.
Figure 4:
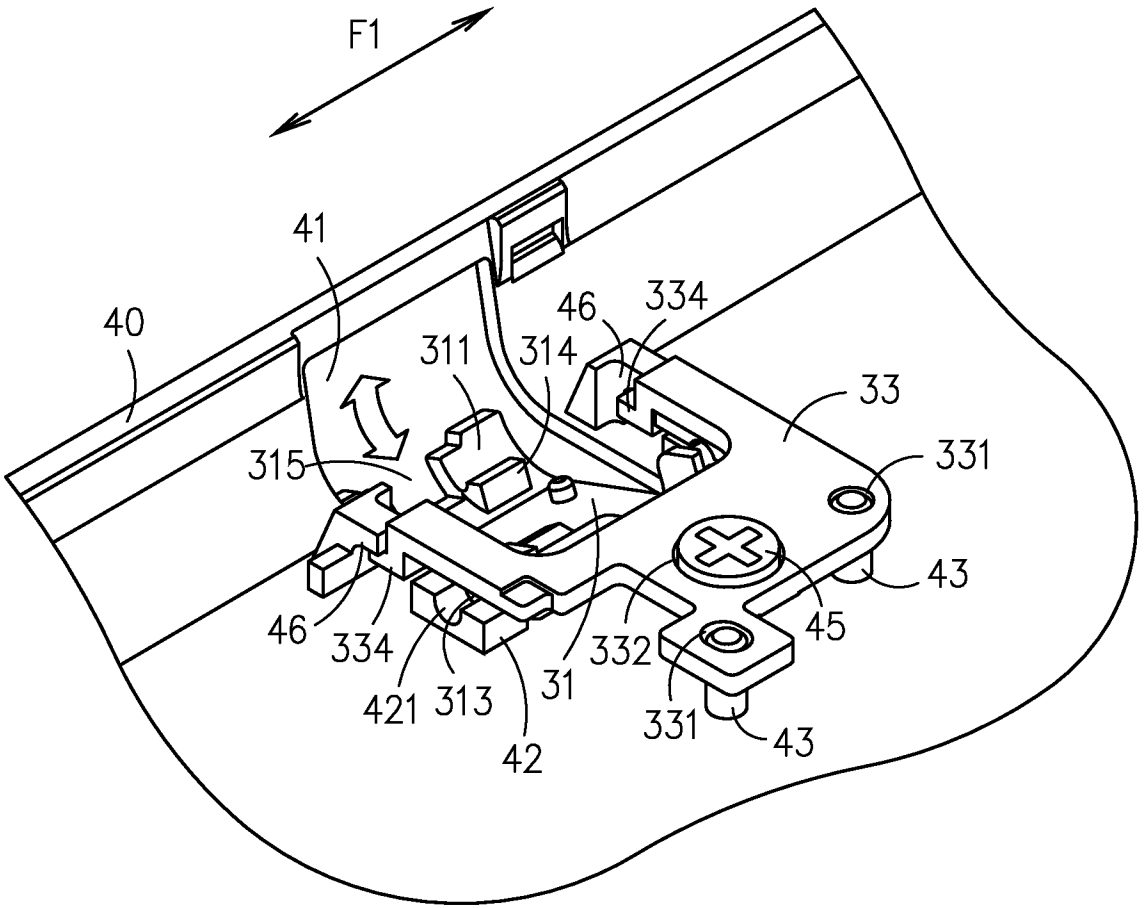
FIG. 4 is a three-dimensional view of the cover structure shown in FIG. 3.

As shown in FIG. 2 to FIG. 4, a cover structure 30 provided in the present invention is adapted for mounting on a housing 40, whereas the housing 40 is formed with an opening 41 and a connection base 50, in which the connection base 50 is configured with a plugging end 51 that has a portion thereof being embedded inside the opening 41 while allowing the rest of the plugging end to expose by the opening 41. It is noted that, through the opening 41, a connector can be plugged into the housing 40.

Moreover, the cover structure 30 comprises: a frame 31, an elastic element 32 and a supporting element 33, that are all designed to be disposed inside the housing 40. It is noted that the housing 40 disclosed in FIG. 2 is only an embodiment, so that it can be formed in any shape or design according to the type of electronic device, the cover structure and the connection base as well whichever it is being adapted for, and thus it is not limited by the one shown in FIG. 2.

In this embodiment, the frame 31 is pivotally coupled to the housing a pivot axis of two pivot block 313 that is arranged in a direction parallel to a first axis direction F1, and also the frame 31 is formed with a first end 311 and a second end 312 that are arranged on two opposite sides of the radial of the pivot axis of the two pivot blocks 313 for allowing the first end 311 to expose by the opening 41, in which the two pivot blocks 313 that are coaxially arranged respectively at two opposite sides of the frame 31 while allowing the axial direction of the pivot axis of the two pivot blocks 313 to be arranged parallel to the first axis direction F1. Moreover, the frame 31 further comprises a locking structure 314, being composed of two locking elements, that is disposed on a surface of the frame facing toward the connection base 50. There is an opening 315 being formed at the first end 311 of the frame 31, whereas the opening 315 can be formed in a shape like a stair.

Figure 5:
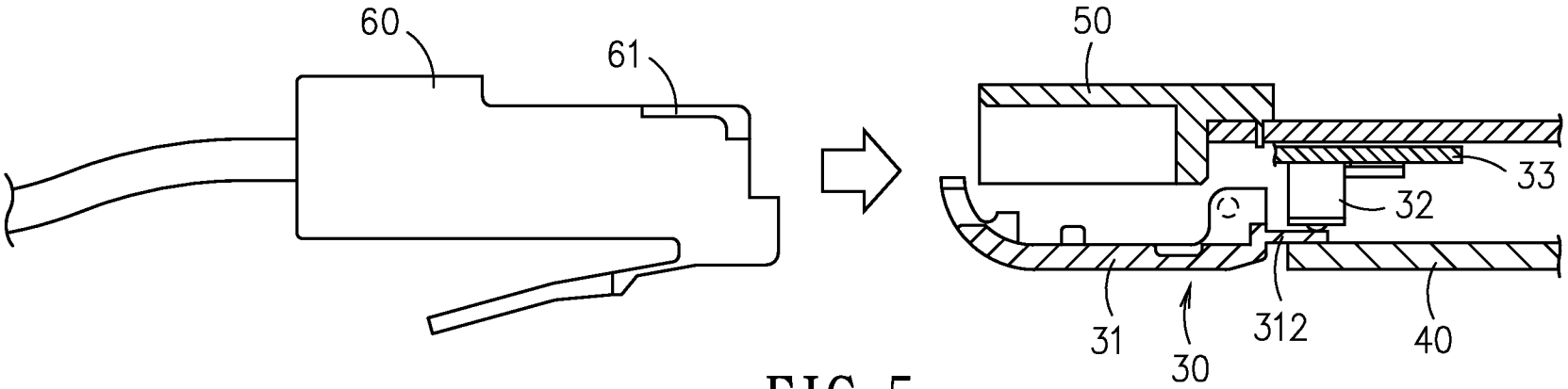
FIG. 5 is a sectional view showing a connector is orientated for preparing the same to be plugged into an accommodation space formed between a connection base and a cover structure of the present invention.

The supporting element 33, which can be a circuit board, is designed to be sandwiched between the frame 31 and the connection base 50, and accordingly, the supporting element 33 is fixed to a specific position relative to the housing 40 by a plurality of alignment elements that are arranged between the supporting element 33 and the housing 40. In this embodiment, the plural alignment elements includes: two holes 331 formed on the supporting element 33; one screw hole 332, also formed on the supporting element 33; two pillars 43, formed on the housing 40 at a position corresponding to the two holes 331; one screw stud 44 with internal thread, formed on the housing 40 at a position corresponding to the crew hole 332; and thereby, each pillar 43 is arranged penetrating through the hole 331 corresponding thereto while allowing each screw stud 44 along with its corresponding screw hole 332 to be screwed through by a screw bolt 45, so that the supporting element 33 can be fixed to the housing 40. In addition, the supporting element 33 is formed with two protrusions 334 on a side 33 thereof that are to be symmetrically arranged thereat while allowing a recess 335 to be formed there between, and the recess 335 is for receiving a plug 61 of a connector 60, as shown in FIG. 5. In this embodiment, free ends of the two protrusions 334 are orientated toward the opening 41 of the housing 40 so as to be locked respectively with two locking bases 46 formed on two opposite sides of the opening 41 of the housing 40. In addition, the housing 40 is configured with two bearings 42 at positions respectively corresponding to the two pivot blocks 313 separately; and each of the two bearings 42 is formed with an arc-shaped concave 421, whereas at positions corresponding to the two bearings 42, the supporting element 33 is correspondingly formed with two arc-shaped concaves 336 on a surface thereof toward the frame 31; and thereby, the two pivot blocks 313 can be clamped by the two arc-shaped concaves 421 of the two bearings 42 and the two arc-shaped concaves 336 of the supporting element 33 when the frame 31 is assembled to the housing 40 while allowing the first end 311 of the frame 31 to expose by the opening 41. By locking the two protrusions 334 to their corresponding locking bases 46, the supporting element 33 can be evenly and fixedly secured to the designated position onto the housing 40 while allowing the two pivot blocks 313 to be fixedly clamped between the two arc-shaped concaves 421 of the two bearings 42 and the two arc-shaped concaves 336 of the supporting element 33.

In this embodiment, the elastic element 32 is substantially a metal elastic piece, but it can be a spring or other parts made of elastic materials. As shown in FIG. 3, the elastic element 32 is formed with two opposite ends 321, 322 in a manner that the end 321 is fixed to a surface of the supporting element 33 that is orientated toward the frame 31, i.e. the bottom surface of the supporting element 33, while allowing another end 332 to contact with the second end 312 of the frame 31 for applying an elastic force thereto and thus enabling the first end 311 and the second end 312 to move relative to each other centering the pivot blocks 313 in a way like a seesaw. After assembling the frame 31, the elastic element 32 and the supporting element 33 to the housing, as shown in FIG. 4, it is then ready for assemble the circuit board 52 with the connection base 50 to the cover structure 30, enabling the plugging end 51 of the connection base 50 to insert into the housing 40 through the opening 41 while allowing a portion of the connection base 50 to expose by the opening 41.

Figure 6:
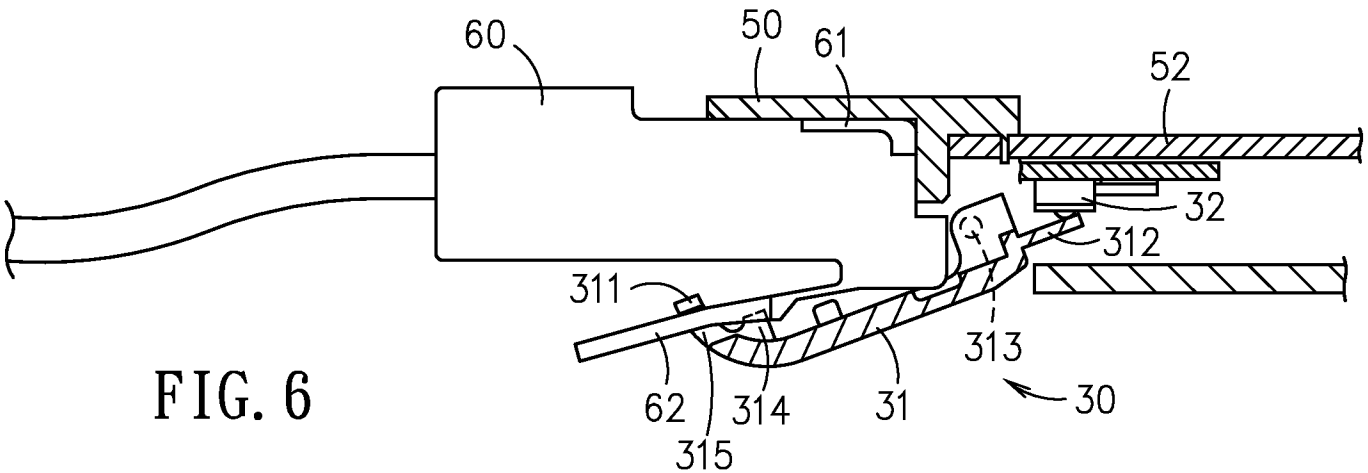
FIG. 6 is a sectional view showing a connector is plugged into an accommodation space formed between a connection base and a cover structure of the present invention.
Figure 7:
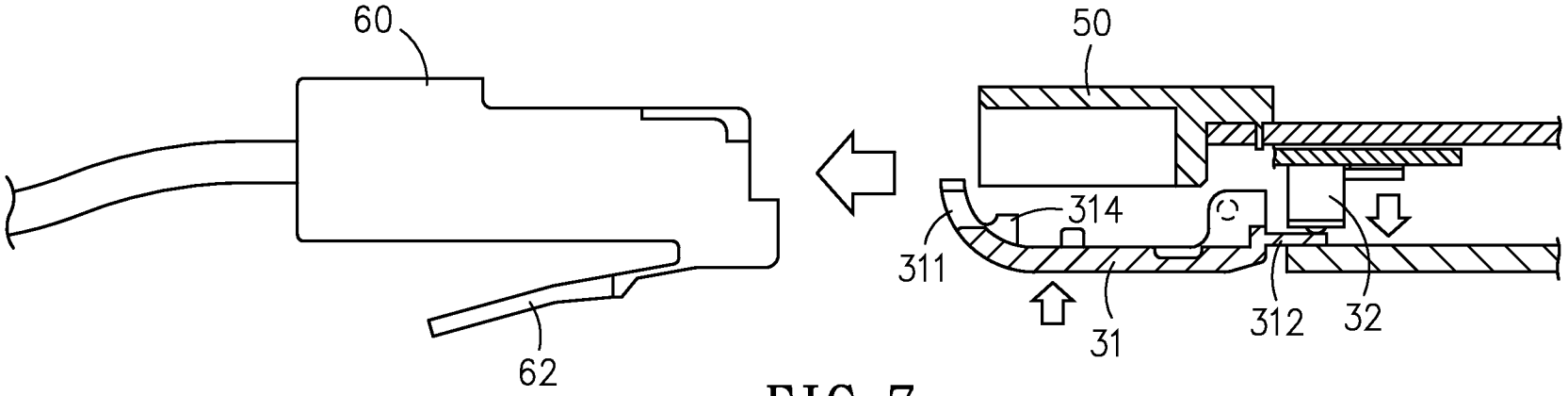
FIG. 7 is a sectional view showing a connector is being pulled out of an accommodation space formed between connection base and a cover structure of the present invention and thus being detached form the connection with the connection base.

With reference to FIG. 5 to FIG. 7, there are embodiments provided to be used for illustrating how a connector can be orientated for preparing the same to be plugged into an accommodation space formed between a connection base and a cover structure of the present invention. It is noted that for emphasizing the relationship between the cover structure 30 and the connection base 50, especially between the frame 31 and the connection base 50, a portion of the housing is not shown in FIG. 5 to FIG. 7.

As shown in FIG. 5, before plugging the connector 60 into the accommodation space that is formed between the connection base 50 and the frame 31, the elastic element 32 that is arranged at the bottom surface of the supporting element 33 is situated in a released state for applying an elastic force on the top of the second end 312 of the frame 31 while enabling the bottom of the second 31 to be disposed abutting against the housing 40, resulting that accommodation space formed between the frame 31 and the connection base 50 is closed.

With reference to FIG. 6, for inserting a portion of the plug of the connector 60 into the accommodation space formed between the frame 31 and the connection base 50, the connector 60 should be enabled to move in a direction perpendicular to the first axis direction F1, as shown in FIG. 3, so that the plug 60 can be orientated properly to enter the accommodation space between the frame 31 and the connection base 50 via the opening 41, and consequently enables the first end 311 of the frame 31 to be forced to move downwardly and the second end 312 of the frame 31 to be pushed upward about the pivot blocks 313, resulting that the elastic element 32 is situated in a compressed state. That is, an accommodation space is formed between the frame 31 and the connection base 50, when the frame 31 is rotating pivotally to an opening position with respect to the housing 40, and consequently, a part of the plug 61 of a connector 60 can be received in the accommodation space. In this embodiment, there is an elastic hook 62 formed on the connector 60 toward the frame 31, that is used for coupling to the locking structure 314 while allowing a portion of the elastic hook 62 to be received in the stair-like opening 315. That is, the two locking elements of the locking structure 314 and the opening 315 is formed on one surface of the frame 31, whereas the surface is orientated toward the connection base 50, while allowing the elastic hook 62 to be formed on one surface of the connector toward the frame 31, so that the two locking elements can be coupled with the elastic hook 62 while allowing a portion of the elastic hook 62 to be received in the opening 315. In an embodiment, the two locking elements and the opening 315 are formed on one surface of the frame 31, whereas the surface is orientated toward the connection base 50 which has an elastic hook 62 formed thereon and orientated toward the frame 31, so that the two locking elements can be coupled with the elastic hook 62 while a part of the connector 60 is receiving in the accommodation space via the opening 41 of the frame 31. In addition, the connection base 50 has an electrical connecting component arranged at a position corresponding to the plug 61 of the connector 60; and when a part of the plug 61 of the connector 60 is enabled to plug into an accommodation space formed between the frame 31 and the connection base 50, the connector 60 will be in contact with the electrical connecting component of the connection base 50 and thus an electrical connection will be achieved between the connector 60 and the connection base 50. Consequently, since the connection base 50 is mounted on the circuit board 52, the connector 60 is electrically connected to the circuit board 52.

Please refer to FIG. 7, which is a sectional view showing a connector is being pulled out of an accommodation space formed between a connection base and a cover structure of the present invention and thus being detached form the connection with the connection base. As shown in FIG. 7, after pressing the elastic hook 62 of the connector 60 for enabling the same to detach from the locking structure 314 of the frame 31, the connector 60 is ready to be pulled out of the accommodation space between the frame 31 and the connection base 50; and after the pulling out of the connector 60, the second end 312 of the frame will be forced to move downward by the elastic force of the elastic element 32 and the first end 311 of the frame 311 will be driven to move upward, resulting that the accommodation space between the frame 31 and the connection base 50 is closed.

Figure 8:
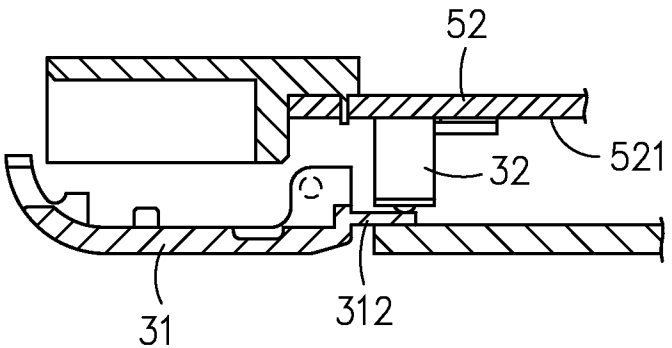
FIG. 8 is a sectional view of a cover structure according to another embodiment of the present invention.

In an embodiment shown in FIG. 8, the elastic element 32 is disposed on a surface 521 of the circuit board 52 that is orientated facing toward the frame 31, i.e. the bottom of the circuit board 52, resulting that the elastic force of the elastic element 32 will be working on the top of the second end 312 of the frame 31. The arrangement of the elastic element 32 shown in FIG. 8 is different from the one shown in FIG. 3, which is disposed at the bottom of the supporting element 33. Consequently, it is noted that the elastic element 32 can be arranged at any location whichever it is capable of operating as it is designed to be, and thus is not limited by the two embodiments shown in FIG. 3 and FIG. 8. For instance, the elastic element 32 can be arranged abutting against a structure of the housing 40, as that is shown in FIG. 2. Nevertheless, it is important to have one end of the elastic element 32 to be fixedly secured, while allowing the opposite end to abut against the top of the second end 312 of the frame 31.

To sum up, the present invention provides a cover structure designed to enable an accommodation space to be formed between itself and a connection base so as to be provided for a connector to plug therein while enabling the connector to be subjected to a clamping force and thus enabling the plugging of the connector into the connection base to be fixedly secured without the danger of loosening.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A cover structure, adapted for mounting on a housing, the housing having a connection base, an opening formed in the housing, the connection base having a plugging end arranged exposing by the opening, comprising:

a frame, pivoted to the housing, the frame including two pivot blocks arranged in a direction parallel to a first axis direction and in the same pivot axis are formed on two opposite sides of the frame, and the frame formed with a first end and a second end, the first and the second ends arranged on two opposite sides of the pivot axis of the pivot blocks, and the first end to expose by the opening; and an elastic element, being arranged inside the housing for providing an elastic force to the frame to enable the frame to rotate pivotally along the pivot axis, and mounted on a supporting element sandwiched between the frame and the connection base;

wherein, an accommodation space is formed between the frame and the connection base, the frame is rotating pivotally to an opening position with respect to the housing, while allowing a part of a plug of a connector is receiving in the accommodation space, the supporting element is fixed to a specific position relative to the housing by a plurality of alignment elements that are arranged between the supporting element and the housing, and the elastic element is mounted on a surface of the supporting element toward the frame for applying an elastic force onto the second end of the frame; and wherein the housing is configured with two bearings at positions respectively corresponding to the pivot blocks separately; each of the two bearings formed with an arc-shaped concave; the two pivot blocks are clamped by the two arc-shaped concaves of the two bearings when the frame is assembled to the housing.

2. The cover structure of claim 1, wherein two locking elements and an opening are formed on one surface of the frame, the surface is orientated toward the connection base, an elastic hook is formed on the connector toward the frame, the two locking elements couple with the elastic hook while a part of the connector is receiving in the accommodation space via the opening of the frame.

3. The cover structure of claim 1, wherein the plural alignment elements includes:

at least one hole, each formed on the supporting element;

at least one screw hole, each formed on the supporting element;

at least one pillar, each formed on the housing at a position corresponding to the at least one hole; and at least one screw stud with internal thread, each formed on the housing at a position corresponding to the at least one screw hole;

wherein each pillar is arranged penetrating through the hole corresponding thereto while allowing each screw stud along with its corresponding screw hole to be screwed through by a screw bolt.

4. The cover structure of claim 1, wherein the supporting element is formed with two protrusions to be symmetrically arranged thereat while allowing a recess to be formed there between; the recess is for receiving the plug of the connector; free ends of the two protrusions are orientated toward the opening of the housing so as to be locked respectively with two locking bases formed on two opposite sides of the opening of the housing.

5. The cover structure of claim 1, wherein the supporting element is a circuit board.

6. The cover structure of claim 1, wherein the elastic element is mounted on a circuit board that is disposed inside the housing; and the elastic element is mounted on a surface of the circuit board facing toward the frame for applying an elastic force onto the second end of the frame.

7. The cover structure of claim 6, wherein the connection base is disposed on the circuit board.

8. The cover structure of claim 1, wherein the connection base and the connector are electrical connecting to each other when a part of the plug of a connector is receiving in the accommodation space via the opening of the housing.

9. The cover structure of claim 1, wherein the elastic element is substantially an elastic piece have two opposite ends that is arranged for allowing one of the ends to be fixedly disposed inside the housing while enabling another end to contact with the frame.

* * * * *